US007482998B2

(12) United States Patent
Purwin et al.

(10) Patent No.: US 7,482,998 B2
(45) Date of Patent: Jan. 27, 2009

(54) SYSTEM AND METHOD FOR DRIVING MULTIPLE DISPLAY TYPES USING A SINGLE HEADER BLOCK

(75) Inventors: Charles J. Purwin, Litchfield, NH (US); Chris R. Franklin, Merrimack, NH (US)

(73) Assignee: Broadcom Corporation, Irvine, CA (US)

( * ) Notice: Subject to any disclaimer, the term of this patent is extended or adjusted under 35 U.S.C. 154(b) by 618 days.

(21) Appl. No.: 11/000,332

(22) Filed: Dec. 1, 2004

(65) Prior Publication Data

US 2006/0114177 A1 Jun. 1, 2006

(51) Int. Cl.
*G09G 3/14* (2006.01)
*G09F 9/33* (2006.01)

(52) U.S. Cl. ..... 345/46; 345/52; 345/82; 345/211; 340/815.45; 340/815.47

(58) Field of Classification Search ..... 345/39, 345/46, 82, 84, 204, 692, 693, 208, 211, 345/212, 52; 340/815.45, 815.47, 500, 525; 315/167, 150, 152, 155, 158, 313, 315, 334
See application file for complete search history.

(56) References Cited

U.S. PATENT DOCUMENTS 5,995,012 A * 11/1999 Lee et al. ..... 340/815.45
6,963,288 B1 * 11/2005 Sokol et al. ..... 340/815.45
7,154,407 B2 * 12/2006 Sokol et al. ..... 340/815.45
2006/0117117 A1 6/2006 Purwin et al.

OTHER PUBLICATIONS

"Single Inverter Open Drain", 74LX1G05, Brochure, STMicroelectronics, Apr. 2004, pp. 1-10.
"Inverter With Open-Drain Output", 74AHC1G06, 74AHCT1G06, Data Sheet, Philips Semiconductors, Oct. 2002, pp. 1-15.
"Octal D-type Flip-flop With 5-volt Tolerant Inputs/Outputs; Positive Edge-trigger (3-state)", 74LVC574A, Product Specification, Jul. 1998, pp. 1-9.

* cited by examiner

*Primary Examiner*—Henry N Tran
(74) *Attorney, Agent, or Firm*—Sterne, Kessler, Goldstein & Fox, P.L.L.C.

(57) ABSTRACT

An LED interface circuit provides connection options for one or more types of LEDs. In an embodiment, the circuit includes an input node that receives an LED control signal, and an output that has a first output node, and a second output node. A driving circuit is disposed between the input header and the output. The driving circuit has a non-inverted input node and an inverted output node. In an embodiment, the inverted output node is capable of sinking current. The non-inverted input node is coupled to the input header and to the first output node, while the inverted output node is coupled to the second output node. The output of the LED interface circuit is capable of driving a plurality of different types of LED displays.

32 Claims, 5 Drawing Sheets

SYSTEM AND METHOD FOR DRIVING MULTIPLE DISPLAY TYPES USING A SINGLE HEADER BLOCK

BACKGROUND OF THE INVENTION

1. Field of the Invention

The invention relates generally to the field of display driving circuits, and in some embodiments, to an interface that can drive differently configured types of LED displays using a single header block.

2. Background

Modem technology relies on a wide variety of electronic devices. Ascertaining the status of electronic devices—e.g., whether a particular device is functioning properly—can be challenging, especially because many users are unfamiliar with how electronic devices operate. Providing visual aids is one way for both technologically unsophisticated users and experienced technicians to ascertain the status of an electronic device. For example, a cell phone may have a visual indicator of the status of its battery. The indicator may be a simple light emitting diode (LED) that comes on when the battery is low, or it may be a more sophisticated icon showing the status of the charge on the battery. Such visual aids help a user to quickly and accurately ascertain the status of an electronic device.

Modem computers are an example of modem technology that incorporate and use a wide variety of electronic circuits. For example, a computer may comprise a modem for communication with other computers, and various memory devices for backing up or saving important data. On many computers, it is challenging for the user to quickly ascertain the status of such devices, especially when the device resides in, or is integral to the computer itself.

There is a need for improved visual display circuits adapted for these and other applications. The inventors have found that there is a need for an improved interface between the user and certain electronic devices that couples a visual indicator, such as an LED, to the electronic device so as to monitor or quickly ascertain device status. Further, the inventors have found that it would be beneficial if the interface accommodates more than one type of visual device.

BRIEF SUMMARY OF THE INVENTION

Additional features and advantages of the invention will be set forth in the description that follows, and in part will be apparent from the description, or may be learned by practice of the invention.

An interface circuit supports a plurality of display devices. In an exemplary embodiment, an LED interface circuit includes an input header that receives an LED control signal, and an output that has a first output node, a second output node, and preferably a ground node. In an embodiment, a driving circuit is disposed between the input header and the output, and has a non-inverted input node and an inverted output node. The non-inverted input node is coupled to the input header and to the first output node in the preferred embodiment, while the inverted output node is coupled to the second output node. The output of the LED interface circuit is capable of driving a plurality of differently configured LED displays in this embodiment.

In another embodiment, an LED interface circuit includes an input header having a number (N) of input nodes capable of receiving LED control signals. An array of N driving circuits are coupled to said N input nodes in a one-to-one fashion. Each of the N driving circuits have a non-inverted input node and an inverted output node, which, in an embodiment, is capable of sinking current. The LED interface circuit further includes an output having N first output nodes, and N second output nodes. In an embodiment, the output also has a ground node. The N non-inverted output nodes are preferably coupled to the N first input nodes in a one-to-one fashion, and the N inverted output nodes are preferably coupled to the N second output nodes in a one-to-one fashion. Such an LED interface circuit is capable of driving a plurality of differently configured LED displays.

In yet another embodiment, a method is disclosed for driving multiple LED display types at an output having a first output node, and a second output node. The output may also have a ground node. The method comprises receiving a display control signal at the output. The display control signal is inverted. At the output, the display control signal is provided at the first output node and the inverted display control signal is provided at the second output node. In an embodiment, the second output node is capable of sinking current. Manipulation of the display control signals in this fashion allows a plurality of differently configured output displays to be driven at the output.

It is to be understood that both the foregoing general description and the following detailed description are exemplary and explanatory and are intended to provide further explanation of the invention as claimed. Neither the Summary of the Invention nor the Detailed Description are intended to limit the scope of the invention beyond what is claimed.

BRIEF DESCRIPTION OF THE DRAWINGS/FIGURES

The accompanying drawings, which are included to provide a further understanding of the invention and are incorporated in and constitute part of this specification, illustrate embodiments of the invention. Together with the description, they serve to provide examples of implementation of the invention. In the drawings.

Figure 1:
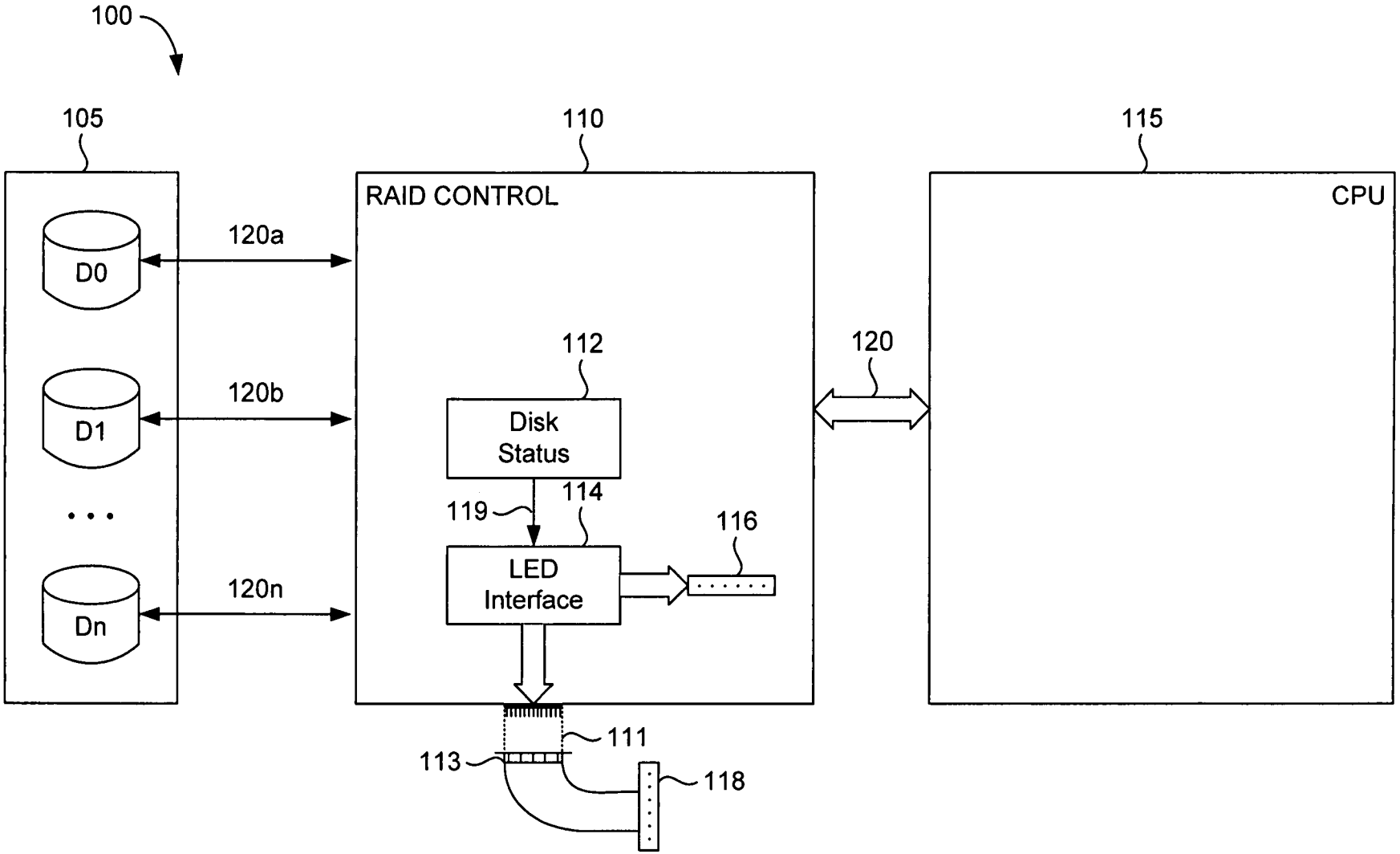
FIG. 1 illustrates an operating environment of the present invention.

The present invention will now be described with reference to the accompanying drawings. In the drawings, like reference numbers indicate identical or functionally similar elements. Additionally, the leftmost digit or digits of a reference number identify the figure in which the reference number first appears.

DETAILED DESCRIPTION OF THE INVENTION

While the present invention is described herein with reference to illustrative embodiments for particular applications, it should be understood that the invention is not limited thereto. Those skilled in the art with access to the teachings provided herein will recognize additional modifications, applications, and embodiments that fall within the scope of the claims, and additional fields in which the invention would be of significant utility.

The present invention is generally directed to a system for visually displaying the status of an electronic device. In exemplary embodiments, an LED interface circuit drives a plurality of LEDs, each representing the status of a corresponding electronic circuit or device. The interface circuit described herein allows a plurality of differently configured LED arrays to be connected to a system employing this LED interface. An exemplary environment in which some embodiments of the present invention may operate is illustrated in FIG. 1.

FIG. 1 illustrates an LED interface 114 as it is used in one embodiment of a controller for a redundant array of inexpensive disks (RAID). The RAID array 105 is coupled to a RAID controller 110. RAID controller 110 is coupled to a central processing unit 115. Data 120 passes between central processing unit 115 and RAID controller 110. The RAID controller determines how the data 120*a*, 120*b*, through 120*n*, is distributed between the individual disks in the array represented by D0, D1, through Dn. One important function of RAID controller 110 is to monitor the status of memory disks D0-Dn. This is accomplished by the disk status function 112 in RAID controller 110. It is useful for the user of RAID controller 110 to be able to determine the status of the individual memory disks D0-Dn that make up the array. A simple way to view the status of the individual disks in real time is to use an LED array.

For example, in an embodiment, an onboard LED array 116 is coupled to LED interface 114. The onboard LED array 116 visually alerts the user of the status of memory disks D0-Dn. Specifically, one LED is present for each disk. The LED status—i.e., whether the LED is on or off—alerts the user as to the status of the corresponding disk. Additionally, an external LED array 118 may also be coupled to LED interface 114. External LED array 118 may be coupled to RAID controller 110 by a simple parallel interface represented by, for example, external pins 111 and a female receptor plug 113. In this exemplary environment, then, the disk status function 112 sends individual disk status signals (e.g., LED control signals) 119 to LED interface 114. LED interface 114 is thereafter coupled to an onboard LED array 116 and an external LED array 118. As further described below, external LED array 118 may consist of a plurality of differently configured LEDs, thereby increasing flexibility for the user.

While the present invention is described in the context of a RAID controller, it is not limited thereto. The invention is designed to function wherever there is a need for a visual aid, such as an LED or other visual indicating device, to monitor the status of electronic devices. Further, the invention is not limited to particular locations of the visual indicating devices, which may be onboard, external, or in any other location or combination of locations.

Figure 2A:
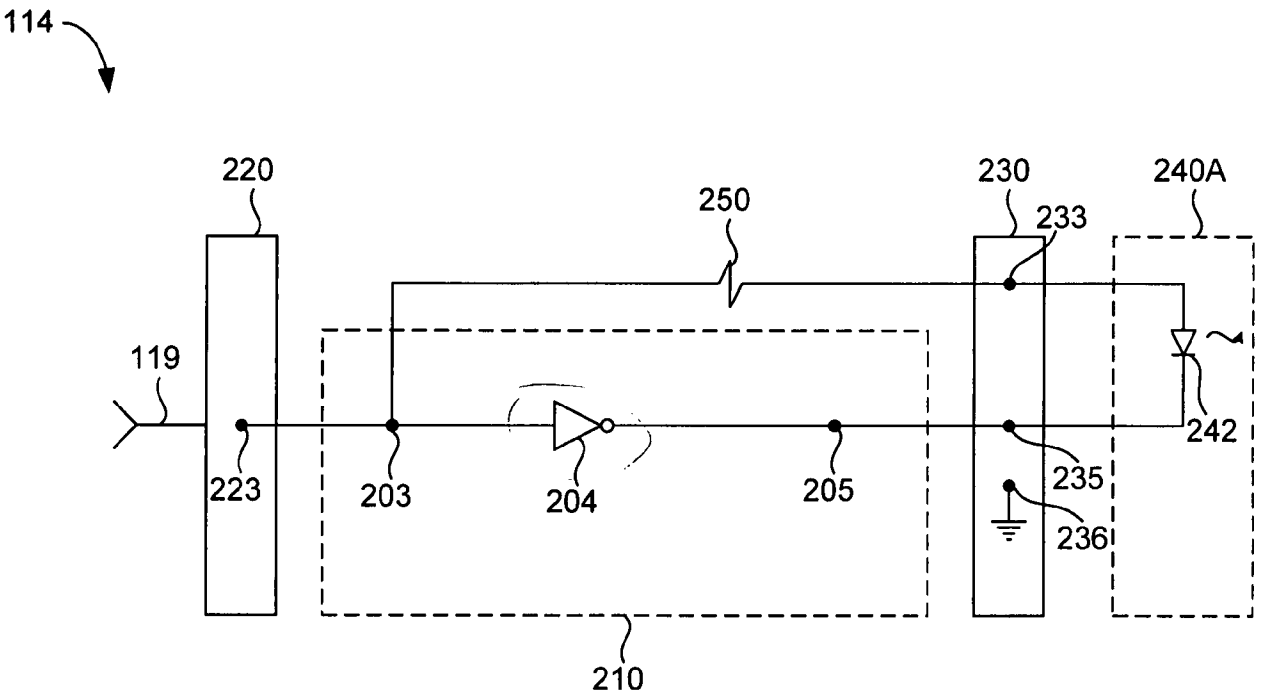
FIG. 2A illustrates an interface having a single driving circuit.

FIG. 2A more specifically illustrates one embodiment of LED interface 114. LED interface 114 includes an input header 220. Input header 220 receives, for example, LED control signals 119 from the disk status function 112. Input header 220 has one or more input nodes 223. In an embodiment, serial LED control signals are received into a deserializer circuit that converts the serial signal to a parallel signal. The deserialized (i.e., parallel) signals are then supplied to coupling flip-flop that provides individual LED control signals, in parallel, to one or more input nodes of input header 220. LED interface circuit 114 also includes an output 230. Output 230 has one or more output nodes. In the embodiment shown, output 230 has a first output node 233, a second output node 235, and, optionally, a ground node 236.

Disposed between input header 220 and output 230 is a driving circuit 210. In one embodiment, driving circuit 210 comprises an open drain inverter 204. Examples of such open drain inverters are the 74AHCT1G06, manufactured by Philips Semiconductors, or the 74LX1G05, manufactured by ST Microelectronics.

Driving circuit 210 has a non-inverted input node 203 and an inverted output node 205. Preferably, inverted output node 205 is capable of sinking current. The current sinking feature is enabled, in one embodiment, by the open drain feature of open drain inverter 204. However, the invention is not limited to the use of an open-drain inverter in driving circuit 210. Driving circuit 210 may incorporate other circuit elements that provide appropriate output signals and current sinking capability as may be required for the specific configuration of the display and signal devices.

Driving circuit 210 is coupled to input header 220 and output 230 as follows. Non-inverted input node 203 is coupled to the input node 223 of input header 220. Non-inverted input node 203 is also coupled to the first output node 233. A resistor 250 may be disposed between non-inverted input node 203 and first output node 233 to limit the forward current through LED 242. In an exemplary embodiment, resistor 250 is 470Ω. Inverted output node 205 is coupled to the second output node 235 of output 230. In sum then, output 230 has a first output node 233 that is coupled to the non-inverted input of driving circuit 210, while the second output node 235 of output 230 is coupled to the inverted output node 205 of driving circuit 210.

In the embodiment described in FIG. 2A, an LED display 240*a* is coupled to output 230. In the example shown, LED display 240*a* comprises a single LED 242. However, any number of LED's or other electronically controlled display elements may be provided and connected to one or more driving circuits 210. The single LED 242 has its anode coupled to the first output node 233 of output 230, and its cathode coupled to the second output node 235 of output 230. The single LED 242 works in this configuration because, as noted above, the second output node 235 is coupled to the inverted output node 205 of driving circuit 210, which is capable of sinking current.

Referring to FIGS. 1 and 2A, an embodiment may work as follows. Disk status 112 of RAID controller 110 may be programmed such that when one of the individual RAID disks D0-Dn is not working properly, the LED status signal 119 for that disk is logic high (e.g., 3.3V). For properly working disks, the LED status signal 119 would be logic low (e.g., 0V). Thus, when a disk stops functioning properly, a logic high LED status signal 119 is sent to LED interface 114 for that disk. If a logic high signal is received at input node 233, then a logic high signal will also be present at non-inverted input node 203 of driving circuit 210. If the voltage at non-inverted input node 203 is high, then the voltage at inverted output 205 of driving circuit 210 is low. Such a condition results in a high voltage signal at first output node 233 (as limited by resistor 250), and a low voltage signal at second output node 235.

As can be seen in FIG. 2A, this results in the voltage at the anode of LED 242 being higher than the cathode. Because of the current sinking feature of second output node 235, such a condition causes current to flow from anode to cathode, thereby causing LED 242 to emit light. This would indicate to a user that the RAID disk associated with that particular LED was not functioning. Conversely, if the disk were functioning, a low voltage signal would be present at first output node 233, and a high voltage signal would be present at second output node 235. In this condition, LED 242 would not emit light, indicating to the user that the disk associated with that LED was working properly.

Other LED configurations are possible as well. For example, the cathode of single LED 242 could be coupled to any ground node, such as ground node 236, instead of the second output node 235. Alternatively, if single LED 242 were a logic driven LED, its anode could be coupled to a power supply, and its cathode could be coupled to second output node 235. These alternate configurations illustrate the flexibility of an LED interface according to the present invention.

Figure 2B:
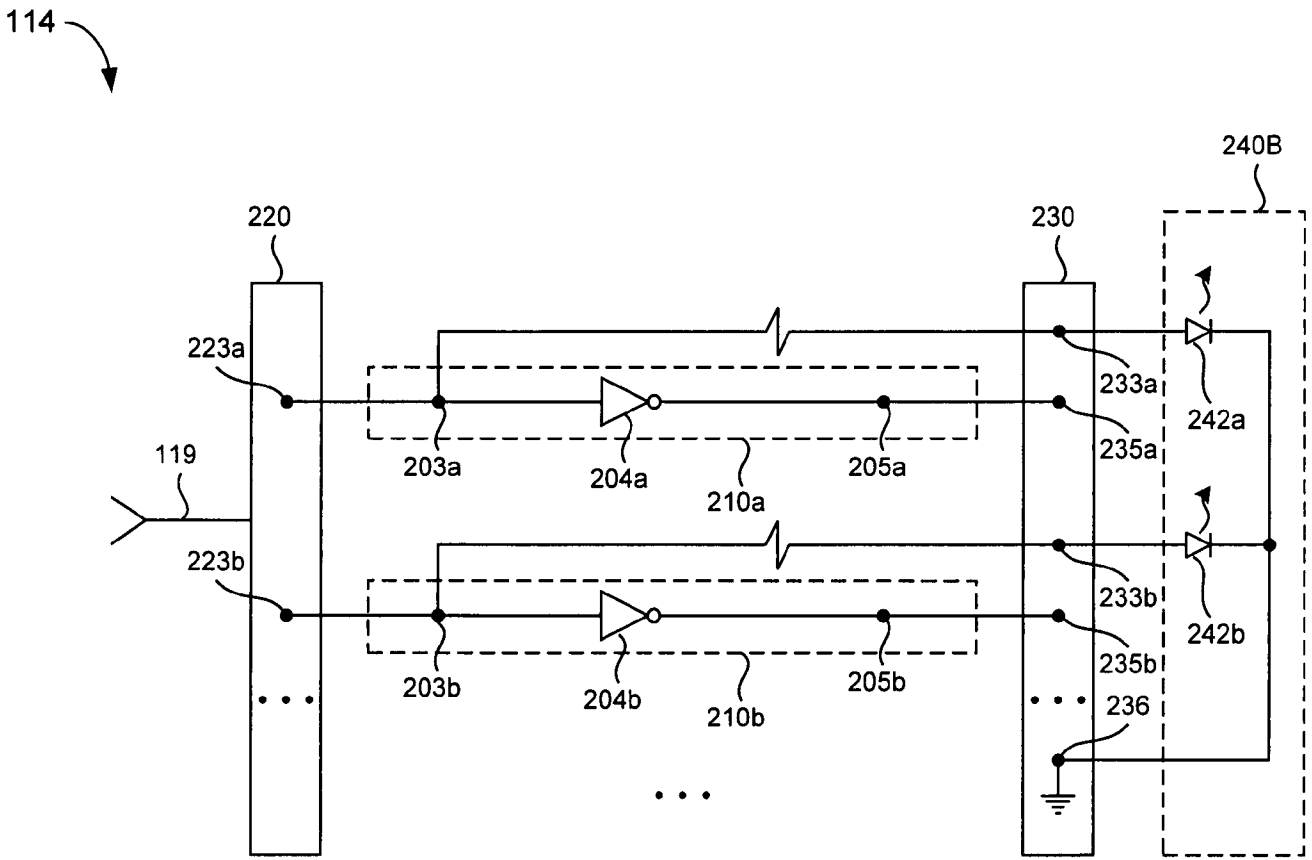
FIG. 2B illustrates an interface having multiple driving circuits.

FIG. 2B illustrates another embodiment of the present invention. In FIG. 2B, a plurality of driving circuits 210*a*, 210*b* are disposed between input header 220 and output 230. For clarity, only two driving circuits (N=2) are shown in FIG. 2B. However, any number (N) of driving circuits can be implemented. If desired, the number of driving circuits used may reflect the number of electronic devices for which a visual indication of status is desired. For example, if RAID controller 110 uses eight separate memory disks, then eight (N=8) driving circuits may be provided in LED interface 114.

In this embodiment, two driving circuits, 210*a* and 210*b*, are disposed between input header 220 and output 230 in a one-to-one fashion, in the same manner described above with respect to FIG. 2A. Specifically, non-inverting input nodes 203*a* and 203*b* are coupled to input nodes 223*a* and 223*b* of input header 220, and to first output nodes 233*a* and 233*b* of output 230. Similarly, the inverted output nodes 205*a* and 205*b* of driving circuits 210*a* and 210*b* are coupled to second output nodes 235*a* and 235*b* of output 230.

LED display 240*b* is coupled to output 230. In the embodiment shown in FIG. 2B, LED display 240*b* comprises a ganged return LED display. The ganged return LED display 240*b* comprises, in this embodiment, two LEDs 242*a* and 242*b*. LEDs 242*a* and 242*b* have their respective anodes coupled to first output nodes 233*a* and 233*b*, while the cathodes of LEDs 242*a* and 242*b* are ganged together, and thereafter coupled to ground node 236 of output 230, or to another ground terminal (not shown). As described above, driving circuits 210*a* and 210*b* can be any circuit capable of inverting an electronic control signal. Additionally, the inverted outputs 205*a* and 205*b* of driving circuits 210*a* and 210*b* are preferably capable of sinking current.

Figure 2C:
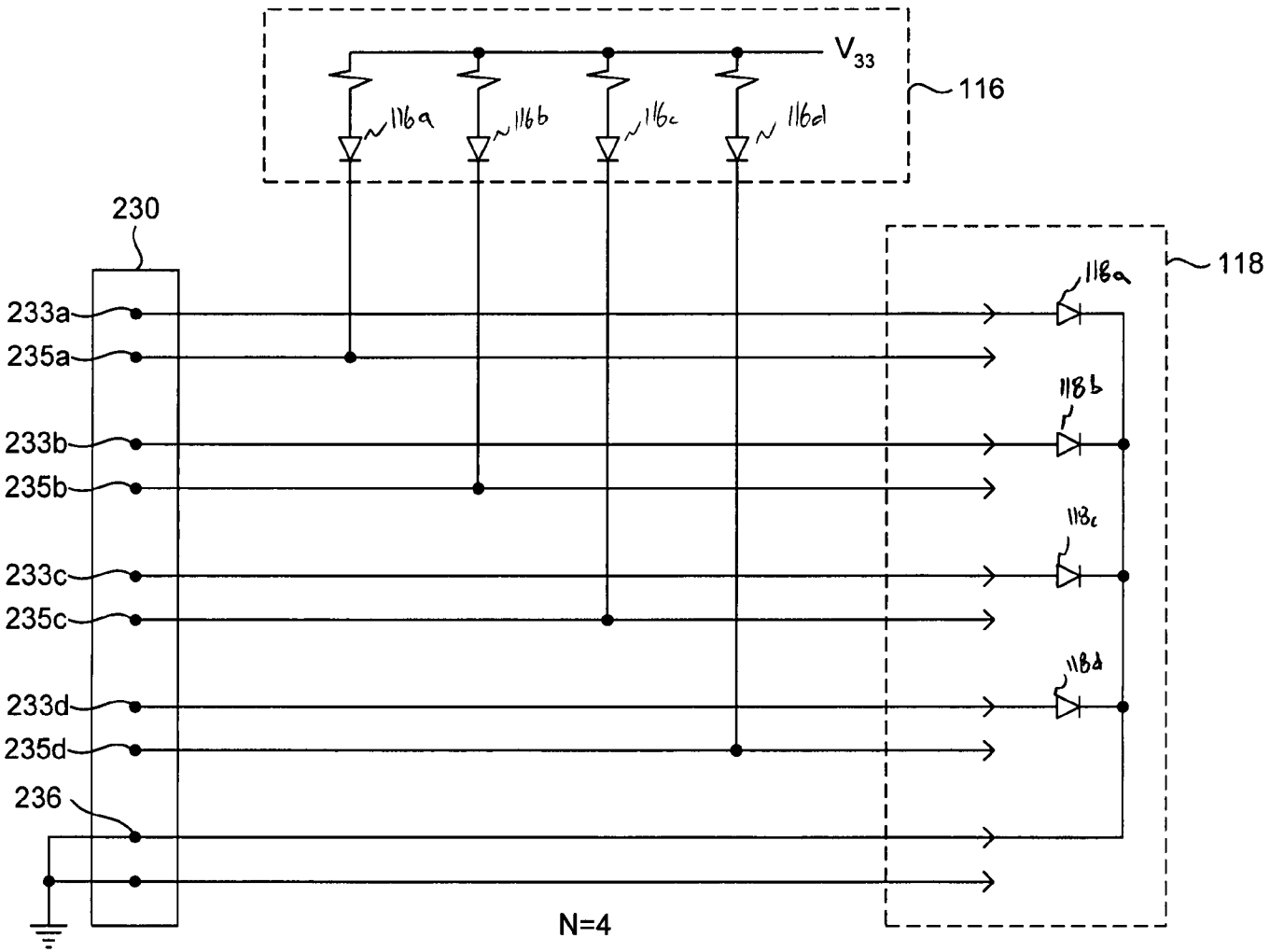
FIG. 2C illustrates how displays with different configurations.

FIG. 2C illustrates another embodiment where a plurality of differently configured LED arrays are coupled to output 230. In the embodiment shown, there are four driving circuits (N=4) (not shown) driving an array of four indicating devices, for example, LEDs. Output 230 thus comprises four first output nodes 233*a*, 233*b*, 233*c*, and 233*d*, and four second output nodes 235*a*, 235*b*, 235*c*, and 235*d*. Preferably, output 230 also has ground node 236. As will be appreciated from the above descriptions, in the embodiment shown, output nodes 233*a* through 233*d* are coupled to the non-inverted input nodes (not shown in FIG. 2C) of a driving circuit, such as driving circuit 210, preferably in a one-to-one fashion. Similarly, second output nodes 235*a* through 235*d* would be coupled to the inverted output nodes (not shown in FIG. 2C) of a driving circuit, such as driving circuit 210, preferably in a one-to-one fashion.

It should be noted that any number (N) of driving circuits and any number of indicating devices may be provided. The indicating devices provided in this and all other embodiments may be LEDs, or any other suitable electrically controlled indicator. Moreover, the invention is not limited to one-to-one designs; each driving circuit may drive one or more indicators, or none at all.

Referring back to FIG. 1 for illustrative purposes, FIG. 2C shows one way in which an onboard LED array 116 and/or an external LED array 118 may be coupled to LED interface circuit 114 of the present invention. In the embodiment of FIG. 2C, onboard LED display 116 is a logic-driven LED array. The anodes of the individual LEDs 116*a*-116*d* are coupled to a power supply $V_{33}$, while the cathodes of the individual LEDs 116*a*-116*d* are coupled to the inverted output nodes 235*a* through 235*d*. Recall from above that output nodes 235*a* through 235*d* are preferably capable of sinking current, which allows a logic-driven LED array to be coupled and driven in this fashion. For example, if a logic low signal (e.g., 0V) were present at second output node 235*a*, and $V_{33}$ were 3.3V, then current would from anode to cathode in LED 116*a*, thereby causing LED 116*a* to emit light.

External LED array 118, according to the embodiment described in FIG. 2C, shows another example of a ganged return LED array. Here, the anodes of the individual LEDs 118*a*-118*d* are coupled to output nodes 233*a* through 233*d*, which represent the non-inverted input node of a driving circuit such as driving circuit 210, while the cathodes of the individual LEDs 118*a*-118*d* in LED display 118 are ganged together and coupled to ground node 236 of output 230. Therefore, if a logic high signal (e.g., 3.3V) were present at second output node 233*a*, then current would flow from anode to cathode, thereby causing LED 118*a* to emit light. As can be seen, such a configuration ensures that LEDs 116*a* and 118*a* display the same status information for their corresponding electronic device.

As noted above, other LED configurations are possible as well. For example, the cathodes of individual LEDs 118*a*-118*d* could be ganged together and coupled to any of the second output nodes, such as second output node 235*a*, instead of ground node 236. Alternatively, the cathodes of individual LEDs 118*a*-118*d* could be coupled to their respective second output nodes 235*a*-235*d*, instead of ground node 236. Such alternate configurations illustrate the flexibility of an LED interface according to the present invention.

Figure 3:
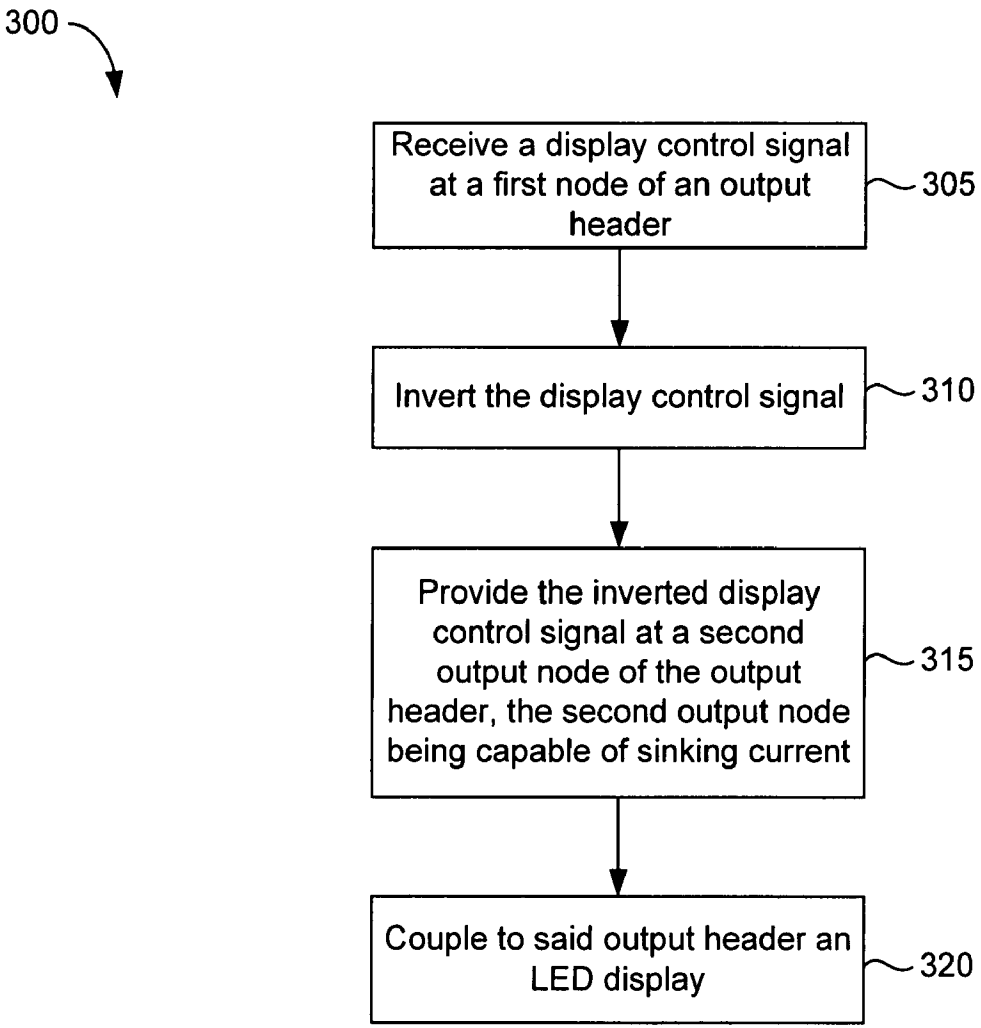
FIG. 3 illustrates a method according to the present invention.

FIG. 3 is a flow chart illustrating method 300, which represents another embodiment of the present invention. More specifically, method 300 is a method for driving differently configured LED displays at an output having at least one first output node, at least one second output node, and one or more ground nodes (e.g., first output node 233, second output node 235, and ground node 236). According to step 305, a display control signal is received at the first output node. An example of a display control signal is LED control signal 119 described above. Next, according to step 310, the display control signal 119 is inverted. As an example, this inverting step may be accomplished with a driving circuit such as driving circuit 210, described above. In step 315, the inverted display control signal of step 310 is provided at a second output node. In an embodiment, the second output node is capable of sinking current. Finally, according to step 320, an LED display is coupled to output 230.

As described above, several different LED display configurations are possible. For example, the LED display could be a logic driven LED display such as onboard LED display 116, or a ganged return LED display such as external LED display 118.

By manipulating the display control signals as described in method 300, a plurality of differently configured LED displays may be coupled to output 230. Such a method increases user flexibility by permitting the user to choose among various types of external LED display configurations. As fully described above, while method 300 is described in the context of a single display signal, the method may also be applied where there are any number (N) of display signals.

The present invention has been described above with the aid of functional building blocks and method steps that illustrate the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. An LED interface circuit, comprising:

an input header, having an input node configured to receive an LED control signal;

an output header having a first output node and a second output node; and a driving circuit, coupled to said input node, and to said output header, configured to receive said LED control signal and to provide a non-inverted output signal at said first output node and an inverted output signal at said second output node, wherein said non-inverted and inverted output signals are based on said LED control signal.

2. The circuit of claim 1, wherein said second output node is capable of sinking current.

3. The circuit of claim 1, wherein said LED control signal represents the status of an electronic device coupled to said input node.

4. The circuit of claim 3, wherein said electronic device is a memory disk in a redundant array of inexpensive disks (RAID).

5. The circuit of claim 1, wherein said driving circuit comprises an open-drain inverter.

6. The circuit of claim 1, further comprising an LED coupled to said first output node and to said second output node.

7. The circuit of claim 1, further comprising a ground node and an LED coupled to said first output node and to said ground node.

8. The circuit of claim 1, further comprising an LED coupled to one of said first or second output nodes and to a power source.

9. The circuit of claim 1, further comprising:

a number (N) of said driving circuits;

wherein said input header is configured to receive N of said LED control signals; and wherein said output header further comprises N of said first output nodes and N of said second output nodes; and whereby said output header is capable of driving a plurality of configurations of LED arrays.

10. The circuit of claim 9, wherein one of said configurations of LED arrays is a ganged return LED array.

11. The circuit of claim 9, wherein one of said configurations of LED arrays is a logic driven LED array.

12. The circuit of claim 9, wherein one of said configurations of LED arrays is an array of single LEDs.

13. The circuit of claim 9, wherein each of said LED control signals represents a status of a memory disk in a redundant array of inexpensive disks (RAID).

14. An LED interface circuit for driving multiple configurations of LED displays, comprising:

an input header having a number (N) of input nodes, each input node capable of receiving an LED control signal;

N driving circuits, each driving circuit having a non-inverted node and an inverted node, wherein said N non-inverted nodes are coupled to said N input nodes in a one-to-one fashion; and an output header having N first output nodes and N second output nodes, wherein said N non-inverted nodes are coupled to said N first output nodes in a one-to-one fashion, and said N inverted nodes are coupled to said N second output nodes in a one-to-one fashion.

15. The circuit of claim 14, wherein said N LED control signals represent the status of N electronic devices coupled to said input header.

16. The circuit of claim 15, wherein said electronic devices are memory disks in a redundant array of inexpensive disks (RAID).

17. The circuit of claim 14, wherein each of said inverted nodes are capable of sinking current.

18. The circuit of claim 17, wherein each of said driving circuits comprises an open-drain inverter.

19. The circuit of claim 14, further comprises N LEDs, wherein each LED is coupled to one of said N first output nodes and to one of said N second output nodes.

20. The circuit of claim 14, further comprising a ground node and N LEDs, wherein each LED is coupled to one of said N first input nodes and to said ground node.

21. The circuit of claim 14, further comprising N logic driven LEDs, wherein each logic driven LED is coupled to one of said N second output nodes and to a power source.

22. The circuit of claim 14, further comprising N resistors, wherein each resistor is coupled to one of said N non-inverted nodes and to one of said N first output nodes in a one-to-one fashion.

23. An LED interface circuit, comprising:

input means for receiving a number (N) of LED control signals;

driving means for generating

N non-inverted LED driving voltages, wherein each non-inverted LED driving voltage corresponds to one of said N LED control signals, and N inverted LED driving voltages, wherein each inverted LED driving voltage corresponds to one of said N LED control signals; and output means for receiving said N inverted LED driving voltages and said N non-inverted LED driving voltages.

24. The circuit of claim 23, further comprising means for sinking current at a node carrying one of said N inverted LED driving voltages.

25. A method for driving an LED display at an output header, comprising:

receiving a display control signal at a first output node of the output header;

inverting said display control signal;

providing said inverted display control signal at a second output node of the output header; and connecting an LED display to said first output node and said second output node, so that said LED display is activated according to said display control signal.

26. The method of claim 25, wherein the receiving step comprises receiving a number (N) of display control signals at N first output nodes, wherein each first output node receives one display control signal, wherein the inverting step comprises inverting the N display control signals, wherein the providing step comprises providing the N inverted display control signals at N second output nodes, wherein each of the second output nodes receives one of the inverted display signals, and wherein each second output node is capable of sinking current, thereby allowing a plurality of configurations of LED displays to be driven by the output header.

27. The method of claim 26, wherein the connecting step further comprises connecting a ganged return LED array.

28. The method of claim 26, wherein the connecting step further comprises connecting a logic driven LED array.

29. The method of claim 26, wherein the connecting step further comprises connecting an array of single LEDs.

30. The method of claim 26, wherein said N display control signals represent the status of N memory disks in a redundant array of inexpensive disks (RAID).

31. The method of claim 25, wherein said display control signal is an LED driving voltage.

32. The method of claim 25, wherein said inverting step includes using an open drain inverter.

* * * * *